US007513761B2

(12) United States Patent
Lindgren

(10) Patent No.: US 7,513,761 B2
(45) Date of Patent: Apr. 7, 2009

(54) DOUBLE SCREW COMPRESSOR FOR SUPPLYING GAS

(75) Inventor: Mats Lindgren, Vikmanshyttan (SE)

(73) Assignee: Opcon Autorotor AB, Saitsjo-boo (SE)

( * ) Notice: Subject to any disclaimer, the term of this patent is extended or adjusted under 35 U.S.C. 154(b) by 0 days.

(21) Appl. No.: 10/551,836

(22) PCT Filed: Apr. 7, 2004

(86) PCT No.: PCT/SE2004/000563

§ 371 (c)(1),
(2), (4) Date: Jul. 21, 2006

(87) PCT Pub. No.: WO2004/090336

PCT Pub. Date: Oct. 21, 2004

(65) Prior Publication Data

US 2007/0071629 A1 Mar. 29, 2007

(30) Foreign Application Priority Data

Apr. 7, 2003 (SE) ..... 0300997

(51) Int. Cl.
*F03C 2/00* (2006.01)
*F03C 4/00* (2006.01)
*F04C 2/00* (2006.01)

(52) U.S. Cl. ..... 418/201.3; 418/150; 418/179; 418/189; 418/190; 418/201.1

(58) Field of Classification Search ..... 418/150, 418/179, 189–191, 201.1, 201.3, 206.5
See application file for complete search history.

(56) References Cited

U.S. PATENT DOCUMENTS

| | | | | |
|---|---|---|---|---|
| 3,824,873 A | | 7/1974 | Rouverol | |
| 4,028,026 A | * | 6/1977 | Menssen | 418/201.3 |
| 4,492,546 A | * | 1/1985 | Kasuya et al. | 418/201.3 |
| 4,643,654 A | * | 2/1987 | Rinder | 418/201.3 |
| 4,651,588 A | | 3/1987 | Rouverol | |
| 5,554,020 A | * | 9/1996 | Rao et al. | 418/179 |
| 7,008,201 B2 | * | 3/2006 | Heizer | 418/201.1 |

FOREIGN PATENT DOCUMENTS

| | | | | |
|---|---|---|---|---|
| DE | 4407696 | | 9/1995 | |
| JP | 56044492 A | * | 4/1981 | |
| JP | 60085284 A | * | 5/1985 | 418/77 |

* cited by examiner

*Primary Examiner*—Theresa Trieu
(74) *Attorney, Agent, or Firm*—Holland & Hart LLP

(57) ABSTRACT

A double-screw compressor for supplying gas, such as air, to a gas consumer, is provided. The double-screw compressor includes two interacting rotors for compressing the gas and a toothed gearing. The toothed gearing includes a gearing housing with two opposite end walls made of a first material. Two gearwheels made of a second material which has a thermal expansion coefficient different from the thermal expansion coefficient of the first material are mounted in the end walls. In order to reduce the effect of the temperature on the backlash, both gearwheels are designed with one and the same pressure angle which is smaller than 15°.

19 Claims, 5 Drawing Sheets

DOUBLE SCREW COMPRESSOR FOR SUPPLYING GAS

FIELD OF THE INVENTION

The present invention relates to a double-screw compressor for supplying gas to a gas consumer, according to the preamble of patent claim 1. The invention also relates to a method of, in a double-screw compressor for supplying gas, such as air, to a gas consumer, reducing the effect of temperature variations of parts in the double-screw compressor on the functioning of the double-screw compressor. The double-screw compressor and the method according to the invention are especially advantageous for use in supplying gas to a fuel cell.

BACKGROUND OF THE INVENTION

Fuel cells are used below as a particularly favorable example of areas of application of the invention. It will be understood, however, that the invention also finds advantageous application for supplying gas to other gas consumers such as internal combustion engines.

Recently, fuel cells have attracted greater attention and become increasingly valued as an energy source in a number of different applications. In recent years, for example, various vehicles such as buses and private cars have been developed, which are driven entirely or partly by means of fuel cells. However, fuel cell technology still has certain problems as far as efficiency and economy are concerned. Therefore, a great deal of research and development work is being carried out at present in order to develop the technology further and to improve and render more effective the various subsystems included in a fuel cell system. One important such subsystem consists of the devices which are used for supplying compressed air or other gas to the fuel cell. For good functioning and effectiveness of the fuel cell, it is of great importance that the air is supplied to the fuel cell with a constant pressure and flow. Moreover, as for all component subsystems, it is of utmost importance that the air-supplying devices operate with high efficiency because the efficiency of each subsystem directly influences the overall efficiency of the whole fuel cell system.

The double-screw compressor has proved to be very well suited for being used for supplying compressed air to fuel cells because it has a good capacity for generating a uniform air flow under constant pressure. The double-screw compressor comprises two parallel interacting rotors in the form of a male rotor and a female rotor which, in engagement with one another, press the air under gradually increased pressure from the inlet of the compressor to its outlet. The rotors can be designed and driven so that they rotate at the same speed or at multiples of the speed of one another. In order to obtain good efficiency by avoiding leakage of air in the direction toward the inlet, it is of great importance that the backlash between the two rotors and between each rotor and the surrounding compressor housing is as small as possible. At the same time, all contact between the rotors must be avoided as such contact leads to the rotors being damaged or to the compressor as a whole breaking down.

In order to maintain the correct backlash, which is as small as possible, between the rotors, the synchronization of the rotational speed of the rotors is therefore of utmost importance. This synchronization is usually brought about by means of a toothed gearing which comprises two interacting gearwheels which are fixed on the shaft of the respective rotor. The ratio of the gearing is of course selected so that it corresponds to the intended ratio between the rotational speed of the two rotors. The gearwheels are usually designed with conventional inclined involute teeth and have the standardized nominal pressure angle of 20°. The toothed gearing also comprises a toothed gearing housing with opposite end walls in which the gearwheel shafts are mounted. For reasons of cost and manufacturing techniques, it is desirable to design the toothed gearing housing with its end walls made of aluminum while, for reasons of strength, the gearwheels are preferably made of steel.

The known double-screw compressor described above with a conventional toothed gearing has a number of advantages compared with other compressors and pumps as far as supplying air to fuel cells is concerned. The exacting requirements of the fuel cell application in terms of efficiency and precision nevertheless result in certain problems. These problems are also associated with the great temperature ranges within which fuel cell systems and the subsystems included in them, such as the screw compressor, have to be capable of operating. This temperature range is great especially when the fuel cell equipment is used as a drive source for vehicles because the equipment then has to be capable of functioning well down to ambient temperatures as low as −50° C. and up to ambient temperatures of around +50° C. and also beyond this to operating temperatures which can be as much as +200° C. on account of the self-heating of the equipment.

In order to maintain the well-defined small backlash between the male screw and female screw during operation of the double-screw compressor, it is of great importance that the backlash between the interacting teeth in the toothed gearing is on the one hand kept as small as possible and on the other hand kept as constant as possible. In the previously known double-screw compressors where the involute teeth of the toothed gearing have the usual nominal pressure angle of 20°, however, the backlash will vary greatly when the temperature of the component parts varies within the range indicated above. Owing to the fact that the end walls and gearwheels of the toothed gearing are made from materials with different thermal expansion coefficients, these parts will be deformed to different degrees when the temperature varies. The end walls made of aluminum will expand more than the gearwheels made of steel when the temperature rises. In this way, the center distance between the gearwheel shafts mounted in the end walls will increase more than the combined pitch or reference radii of the two gearwheels will when the temperature rises. As a result, the backlash between the gearwheels increases when the temperature rises and in a corresponding way decreases when the temperature falls. This phenomenon constitutes a serious problem because increased backlash gives rise to impaired synchronization of the rotors, which leads to increased gas leakage and impaired efficiency of the double-screw compressor and may moreover lead to the rotors coming into direct contact with one another, the risk of breakdown then being great. On the other hand, reduced backlash can lead to wear of the teeth and, if the backlash becomes negative, to jamming between the teeth with a risk of breakdown. In particular when the fuel cell equipment is used in vehicles, it is precisely problems at low temperatures which are especially serious, because the double-screw compressor should be designed for normal operation at operating temperatures of around +100° C. and moreover so as to handle cold starts at ambient temperatures as low as −50° C.

DE 44 07 696 also describes a previously known cylindrical toothed gearing for vehicle transmissions, in which the gearwheel geometry can be adapted, for example by small corrections of a pressure angle of the order of 26° of the gearwheel pair, in order to shift the optimum operating temperature range of the gearing from ambient temperature to the temperature range in which the gearing normally operates. The object is stated to be to reduce the risk of damage occurring on the tooth flanks.

SUMMARY OF THE INVENTION

The change in the backlash of a toothed gearing included in a double-screw compressor therefore depends, as described above, on the material selection in gearwheel and end wall, on the temperature changes and on the temperature distribution between end wall and gearwheel under different operating conditions. The invention is based on the insight that the nominal pressure angle of the tooth profiles as well influences the change in the backlash in such a way that a nominal pressure angle which is considerably smaller than the 20° applied as a general standard considerably reduces the dependence of the backlash on the temperature.

One object of the present invention is to produce a double-screw compressor for supplying a fluid to a fuel cell, which double-screw compressor has high efficiency and good reliability within great actual operating temperature ranges.

This object and other objects are achieved with a double screw compressor comprising two interacting rotors for compressing the gas and a toothed gearing, which toothed gearing comprises a housing with two opposite end walls which are made of a first material, two parrallel gearwheel shafts which are each connected to one of the rotors and mounted rotatably in the opposite end walls with a nominal center distance, two interacting gearwheels which are fixed on a respective gearwheel shaft and made of a second material, each gearwheel having involute teeth corresponding to one another and designed so as, when engagement between teeth on their respective wheels takes place, to form a nominal backlash between the teeth interacting during the engagement when the gearwheel shafts are located at the nominal center distance from one another, and further having a nominal pressure angle, the first and second materials having different thermal expansion coefficients, characterized in that each of the gearwheels comprises the same nominal pressure angle which is smaller than 15° in order to minimize the deviation of the actual backlash from the nominal backlash when a center distance deviates from the nominal center distance as a consequence of a change in temperature of one of the parts included in the screw compressor.

By designing the tooth profiles of the gearwheels with a nominal pressure angle which is considerably smaller than the usual standard angle of 20°, it has been found that, with a changed operating temperature, the backlash is changed to a considerably smaller degree than is the case with the previously known standard nominal pressure angle. In this way, effective and reliable operation of the double-screw compressor over a considerably greater temperature range than was previously the case is ensured.

In order to avoid undercutting in manufacture of the smallest gearwheel and nevertheless to reduce the temperature-dependence of the backlash adequately, it has been found that the nominal pressure angle is suitably selected within the range 8° to 15°. Particularly good results are obtained if the nominal pressure angle is selected to be around 10°.

In order further to reduce the risk of jamming between the teeth at very low temperatures, such as when cold-starting outdoors in a winter climate, the nominal center distance can be made somewhat greater than is usual. In this connection, it has been found that particularly advantageous results are achieved if the nominal center distance is selected within the range 1.0010 to 1.0016 times the normal center distance and in particular at around 1.0014 times the normal center distance.

Another object is to provide a method of, in such a double screw compressor, reducing the negative effect variations in the operating temperatures have on the functioning of the double-screw compressor. The method, in a double-screw compressor for supplying gas to a gas consumer reducing the effect of temperature variations of parts in the double-screw compressor on the functioning of the double-screw compressor, which double-screw compressor comprises two interacting rotors for compressing the gas and a toothed gearing, where the toothed gearing is designed with (1) a housing with two opposite end walls which are made of a first material, (2) two parallel gearwheel shafts, which are each connected to one of the rotors and mounted rotatably in the opposite end walls with a nominal center distance, and (3) two interacting gearwheels which are fixed on a respective gearwheel shaft and made of a second material, each gearwheel having involute teeth corresponding to one another designed so as, when engagement between teeth on their respective wheels takes place, to form a nominal backlash between the teeth interacting during the engagement when the gearwheel shafts are located at the nominal center distance from one another, and further having a nominal pressure angle, the first and second materials are selected so that they have different thermal expansion coefficients, characterized in that the nominal pressure angle of each of the gearwheels is identical and within the same range 0° to 15° in order to minimize the deviation of the actual backlash from the nominal backlash when a center distance deviates from the nominal center distance as a consequence of a change in temperature of one of the parts included in the screw compressor.

BRIEF DESCRIPTION OF FIGURES

The invention will be described in greater detail as an example, with reference to accompanying drawings, in which.

DESCRIPTION OF ILLUSTRATIVE EMBODIMENTS

Figure 1:
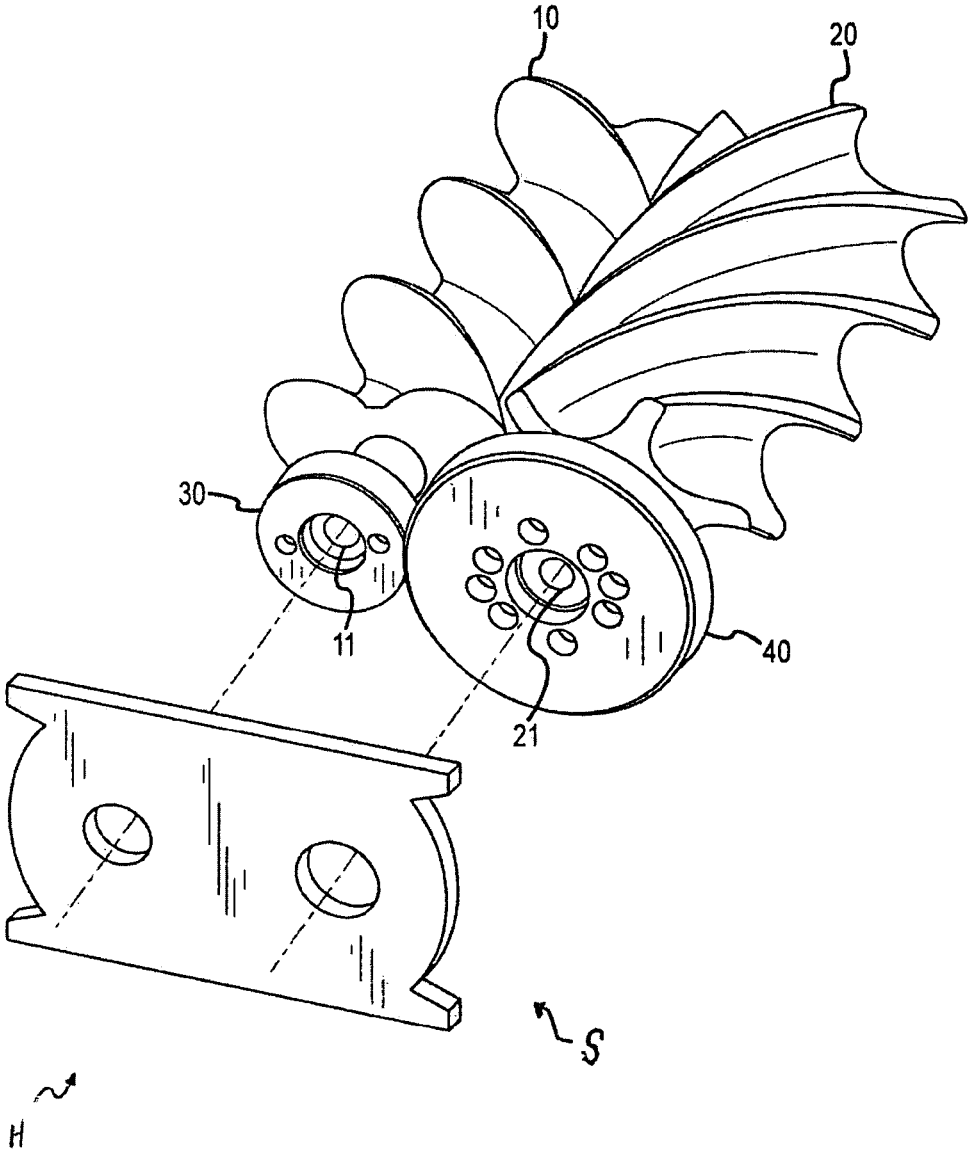
FIG. 1 is a diagrammatic perspective view of certain components included in a double-screw compressor.

FIG. 1 shows diagrammatically parts of a double-screw compressor of the type to which the invention relates. The double-screw compressor comprises two rotors parallel to one another in the form of a male screw 10 and a female screw 20. At their ends, the two screws 10, 20 have axially projecting shaft journals 11, 21. It will be understood that, at the ends opposite the shaft journals 11, 21 as well, the screws have corresponding shaft journals (not shown) for mounting the screws in a compressor housing H having opposite sidewalls S enclosing the screws. A first gearwheel 30 is fixed on the shaft journal 11, and a second gearwheel 40 is fixed in the shaft journal 21. These gearwheels 30, 40 form part of a toothed gearing for synchronization of the rotation of the screws 10, 20. In the embodiment shown, the screws are designed so that the male screw 10 will rotate at twice the rotational speed of the female screw 20. The ratio between the first gearwheel 30 and second gearwheel 40 is therefore 2:1. The toothed gearing also comprises a toothed gearing housing (not shown) which has opposite end walls (not shown) in which the shaft journals 11, 21 and also another two shaft journals (not shown) fastened to respective gearwheels 30, 40 are rotatably mounted. The end walls of the toothed gearing housing and the screws 10, 20 are made of aluminum while the gearwheels 30, 40 are made of steel. The end walls therefore have a greater thermal expansion coefficient than the gearwheels 30, 40.

Figure 2:
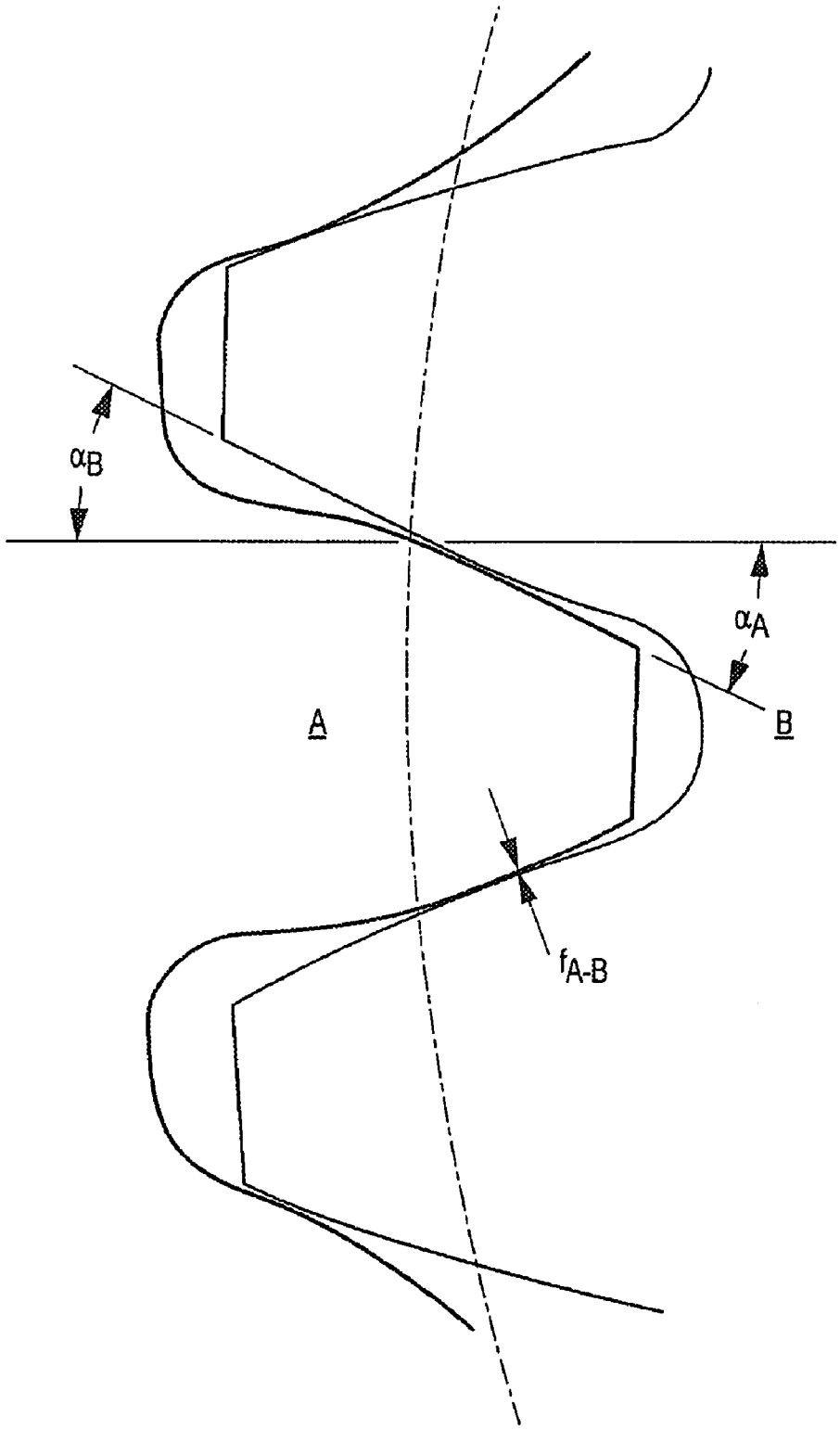
FIG.2 PRIOR ART
FIG. 2 is a diagrammatic illustration which shows the engagement between two gearwheels at a nominal center distance in the toothed gearing of a double-screw compressor according to the prior art.
Figure 3:
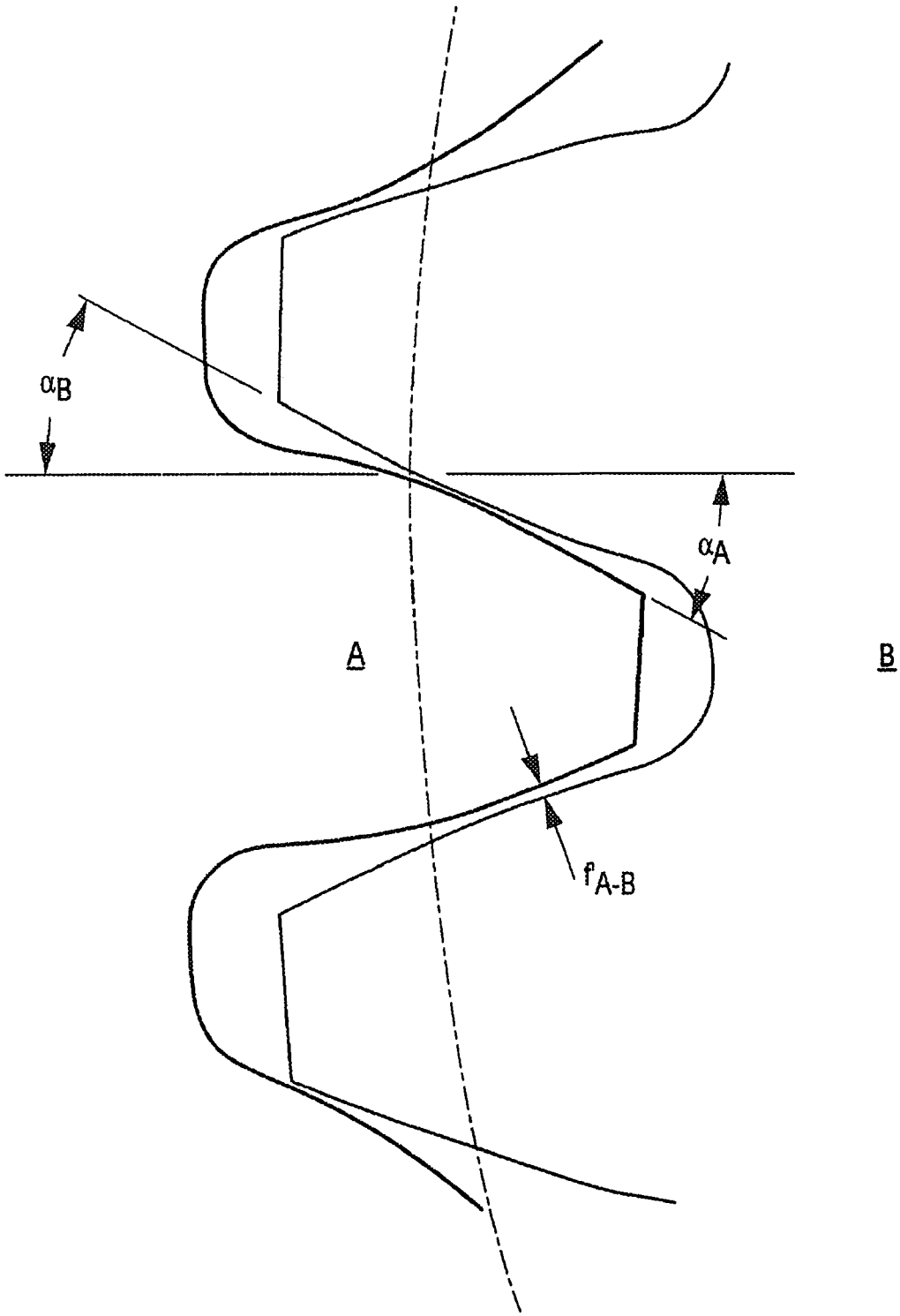
FIG.3 PRIOR ART
FIG. 3 is a diagrammatic illustration which shows the engagement shown in FIG. 1 at a greater center distance.

The design and functioning of the gearwheels is described in greater detail below with reference to FIGS. 2-4. For greater clarity, FIGS. 2 and 3 show on greatly enlarged scale the engagement between two gearwheels A and B at different center distances, the gearwheels being designed according to the prior art. Gearwheel A is designed as an involute gearwheel with the module $m_A$=1, the reference diameter $d_A$=30.480 mm, the number of teeth $z_A$=30 and the helix angle $\beta_A$=26.355°. Gearwheel B is designed as an involute gearwheel with corresponding values: $m_B$=1, the reference diameter $d_B$=60.960 mm, the number of teeth $z_B$=60 and the helix angle $\beta_B$=26.355°. Both gearwheels A and B are also, according to the usual standard, designed with the nominal pressure angle $\alpha_A=\alpha_B$=20°.

FIG. 2 shows the engagement of the gearwheels when the center distance between gearwheels A and B equals 50.290 mm. As can be seen from FIG. 2, the backlash $f_{A-B}$ is very small at this center distance.

FIG. 3 shows the same gearwheels A and B when the center distance between gearwheels A and B has increased to egual 50.340 mm. This increase in the center distance has been caused by an increase in the temperature in the end walls, shafts and gearwheels of the toothed gearing, the end walls between shaft centers having been expanded more than the combined expansion of the reference radii of the gearwheels.

As can be seen clearly from FIG. 3, the increased center distance has resulted in a considerable increase in the backlash to $f'_{A-B}$.

Figure 4:
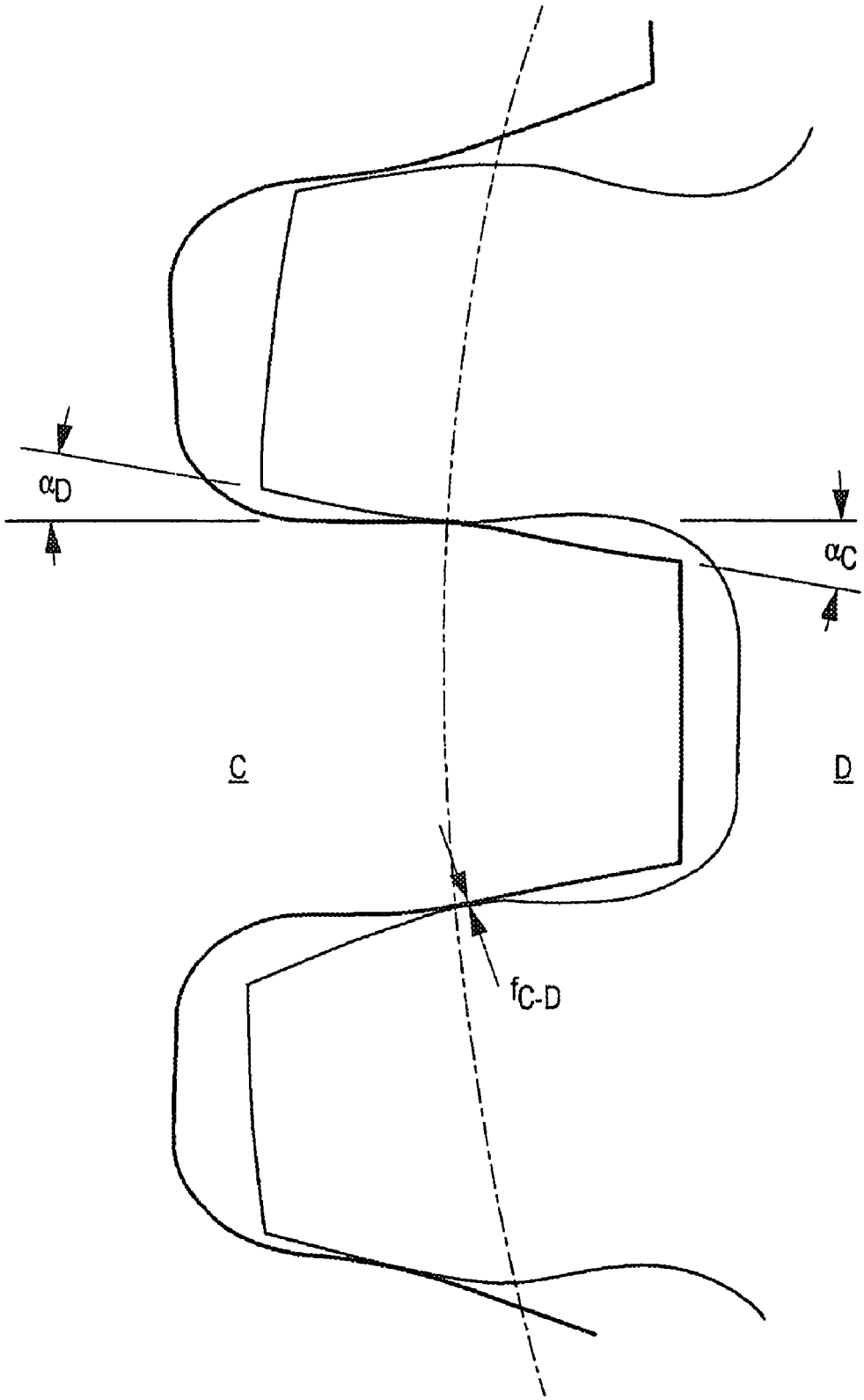
FIG. 4 is a diagrammatic illustration which shows the engagement between two gearwheels at the nominal center distance shown in FIG. 1 in the toothed gearing of a double-screw compressor according to an embodiment of the invention.
Figure 5:
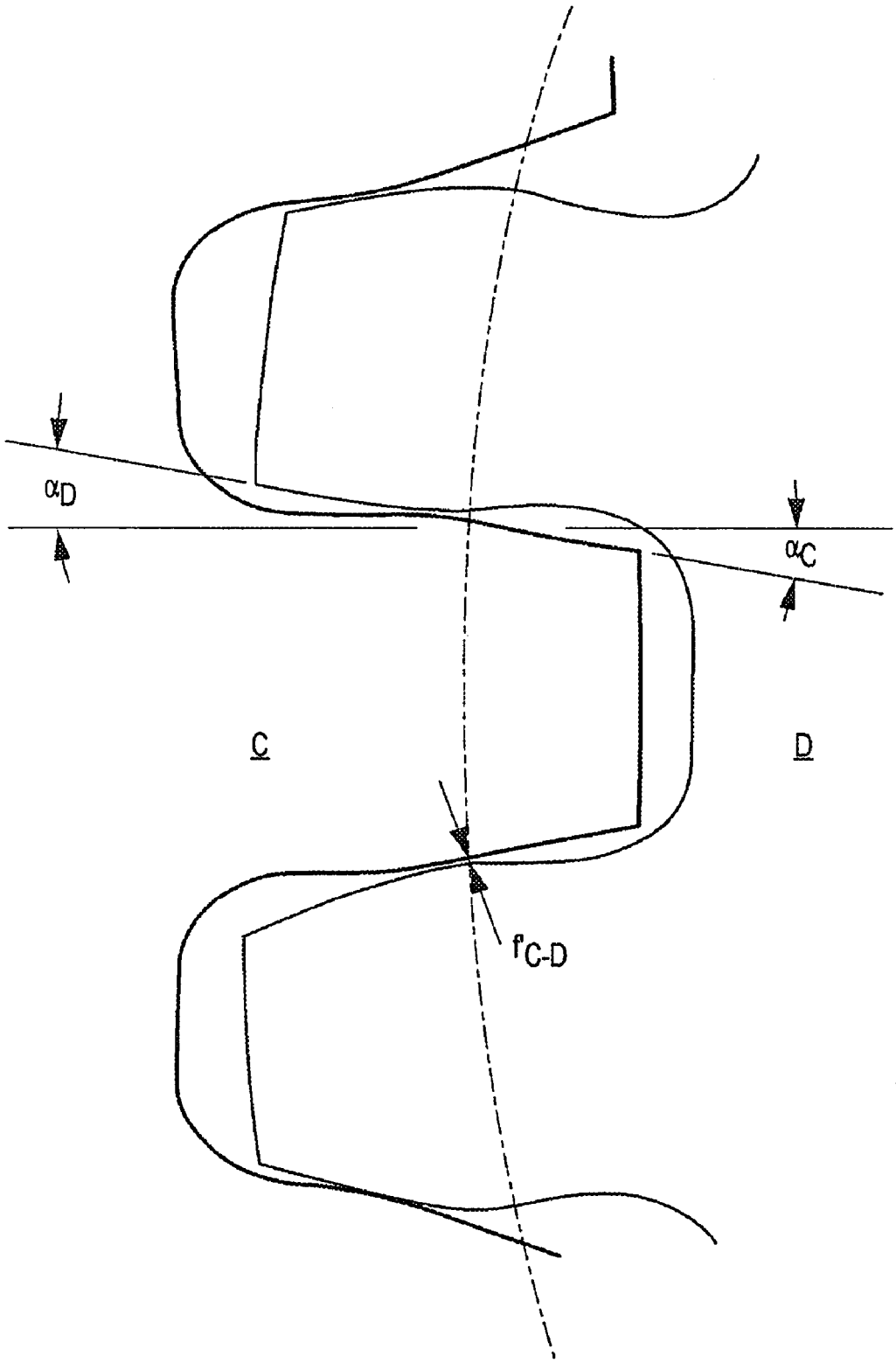
FIG. 5 is a diagrammatic illustration which shows the engagement shown in FIG. 4 at a greater center distance corresponding to that in FIG. 3.

FIGS. 4 and 5 show two involute gearwheels C and D designed according to thc invention when these are in engagement with one another corresponding to the engagement positions shown in FIGS. 2 and 3 respectively. Gearwheels C and D differ from gearwheels A and B described above only in that their nominal pressure angle $\alpha_C=\alpha_D$=10°. Otherwise, the data of gearwheel C is identical with that of gearwheel A described above, and the data of gearwheel D is identical with that of gearwheel B. In the engagement shown in FIG. 4, as in FIG. 2, the center distance between gearwheels C and D eguals 20.290 mm. As can be seen clearly from FIG. 4, the backlash $f_{C-D}$ is then very small.

In the engagement shown in FIG. 5, the center distance has, in the same way as described above with reference to FIG. 3, between gearwheels C and D has increased to equal 50.340 mm. As can be seen from the figure, the backlash $f'_{C-D}$ has in this connection increased slightly in relation to $f_{C-D}$. However, a comparison of FIGS. 5 and 3 shows clearly that the difference between $f'_{C-D}$ and $f_{C-D}$ is considerably smaller than the difference between $f'_{A-B\ and\ fA-B}$. This therefore clearly shows that the dependence of the backlash on temperature-dependent deformations of parts included in the double-screw compressor is reduced considerably if the nominal pressure angle of the gearwheels is selected to be 10° instead of the usual standard-nominal pressure angle of 20°.

Another illustration of this is given in the following example.

EXAMPLE

A toothed gearing with the number of teeth on the wheels 30 and 60 respectively was investigated with two different nominal pressure angles, 15° and 10°, in comparison with the standard angle of 20°. With a module of 1.0 and the center distance of 50.290 mm as the starting position for both cases, and with the same normal backlash, the center distance for 0 backlash in the case of a 15° nominal pressure angle becomes 50.253 mm and in the case of a 10° nominal pressure angle 50.240 mm, while a 20° nominal pressure angle gives 50.262 mm. The permitted center distance changes are therefore 0.037 mm and 0.050 mm respectively in comparison with 0.028 mm with a 20° nominal pressure angle. The toothed gearing with a 10° nominal pressure angle can therefore handle a 79% greater temperature change than the standard toothed gearing before the backlash has been fully reduced. The corresponding figure for a 15° nominal pressure angle is 32%.

According to a preferred embodiment of the double-screw compressor according to the invention, the nominal center distance is moreover selected to be slightly greater than the normal center distance for conventional toothed gearings with a certain geometry. The normal center distance $A_{norm}$ is determined by the formula:

$$A_{norm}=((m_1 \cdot z_1)/2 \cos \beta_1))+((m_2 \cdot z_2)/2 \cos \beta_2))$$

where m is the module, z is the number of teeth and β is the helix angle and where the index numbers $_1$ and $_2$ represent one and the other gearwheel respectively.

For the gearwheels described with reference to FIGS. 2-4, this calculation would lead to the gearwheels nominally being positioned with $A_{norm}$=50.220 mm. According to the preferred embodiment, however, the nominal center distance $A_o$ is selected within the range $1.00 \cdot A_{norm}$ to $1.0016 \cdot A_{norm}$ and is preferably equal to around $1.0014 \cdot A_{norm}$. When the nominal center distance is set at $1.0014 \cdot A_{norm}$, $A_o$=50.290 mm is obtained. This increase in the nominal center distance from the normal center distance results in considerable advantages especially when cold-starting the double-screw compressor according to the invention at low ambient temperatures. This is because the increased nominal center distance allows a greater reduction of the actual center distance at low ambient temperatures without the backlash being eliminated completely or becoming negative, which would otherwise entail a considerable risk of the toothed gearing breaking down during such cold-starting. The risk of the increased nominal center distance leading to backlash which is too great at normal operating temperatures is eliminated or at least considerably reduced by virtue of the fact that the gearwheels are designed with a nominal pressure angle of 10°, the effects described above for reducing the temperature-dependence of the backlash being obtained.

The invention is not to be regarded as being limited to the embodiments described above but can be varied freely within the scope of the patent claims below. For example, the toothed gearing can be constructed with varying values as far as the module, pitch or reference diameters, helix angle, number of teeth and center distance of the component gearwheels are concerned. In the construction of the toothed gearing, however, it should be ensured that the nominal pressure angle is not selected to be too small in relation to other parameters, giving rise to a risk of too great an undercutting of the teeth. As long as the nominal pressure angle is equal to or greater than around 8°, it has been found that this risk does not exist in most construction cases.

The invention claimed is:

1. A double-screw compressor for supplying gas to a gas consumer and comprising two interacting rotors for compressing the gas and a toothed gearing, which toothed gearing comprises:

a. a housing with two opposite end walls which are made of a first material, b. two parallel gearwheel shafts, which are each connected to one of the rotors and mounted rotatably in the opposite end walls with a nominal center distance, c. two interacting gearwheels which are fixed on a respective gearwheel shaft and made of a second material, each gearwheel having involute teeth corresponding to one another and designed so as, when engagement between teeth on their respective wheels takes place, to form a nominal backlash between the teeth interacting during the engagement when the gearwheel shafts are located at the nominal center distance from one another, and further having a nominal pressure angle, d. the first and second materials having different thermal expansion coefficients, characterized in that each of the gearwheels comprises the same nominal pressure angle which is smaller than 15° in order to minimize the deviation of the actual backlash from the nominal backlash when a center distance deviates from the nominal center distance as a consequence of a change in temperature of one of the parts included in the screw compressor.

2. The double-screw compressor as claimed in claim 1, in which the two gearwheels are designed with a nominal pressure angle which lies in the range 8° to 15°.

3. The double-screw compressor as claimed in claim 1, in which the two gearwheels are designed with the nominal pressure angle of around 10°.

4. The double screw compressor as claimed in claim 1, in which the first material is aluminum and the second material is steel.

5. The double-screw compressor as claimed in claim 1, in which the nominal center distance is slightly greater than a normal center distance for toothed gearings, Anorm, which is calculated according to the formula:

$$Anorm=((m_1 \cdot z_1)/2 \cos \beta_1))+((m_2 \cdot z_2/2 \cos \beta_2))$$

where m is the module, z is the number of teeth and β is the helix angle and where the index numbers $_1$ and $_2$ represent one and the other gearwheel respectively.

6. The double-screw compressor as claimed in claim 5, in which the nominal center distance lies within the range 1.0·Anorm to 1.0016·Anorm.

7. The double screw compressor as claimed in claim 6, wherein the nominal center distance is equal to around 1.0014·Anorm.

8. The double-screw compressor as claimed in claim 5, in which $m_1=m_2=1$, $z_1=30$, $z_2=60$, $d_1=33.480$ mm, $d_2=66.960$ mm, and $\beta_1=\beta_2=26.355°$, where m is the module, z is the number of teeth, d is the reference diameter and β is the helix angle and where the index numbers $_1$ and $_2$ represent one and the other gearwheel respectively.

9. The double screw compressor as claimed in claim 1, wherein the gas is air.

10. The double screw compressor as claimed in claim 1, wherein the gas consumer is a fuel cell.

11. The double screw compressor as claimed in claim 1, wherein the gas consumer is a combustion engine.

12. A method of, in a double-screw compressor for supplying gas to a gas consumer reducing the effect of temperature variations of parts in the double-screw compressor on the functioning of the double-screw compressor, which double-screw compressor comprises two interacting rotors for compressing the gas and a toothed gearing, where:

i. the toothed gearing is designed with:

(1) a housing with two opposite end walls which are made of a first material, (2) two parallel gearwheel shafts, which are each connected to one of the rotors and mounted rotatably in the opposite end walls with a nominal center distance, (3) two interacting gearwheels which are fixed on a respective gearwheel shaft and made of a second material, each gearwheel having involute teeth corresponding to one another designed so as, when engagement between teeth on their respective wheels takes place, to form a nominal backlash between the teeth interacting during the engagement when the gearwheel shafts are located at the nominal center distance from one another, and further having a nominal pressure angle, ii. the first and second materials are selected so that they have different thermal expansion coefficients, characterized in that iii. the nominal pressure angle each of the gearwheels is identical and within the same range 0° to 15° in order to minimize the deviation of the actual backlash from the nominal backlash when the center distance deviates from the nominal center distance as a consequence of a change in temperature of one of the parts included in the screw compressor.

13. The method as claimed in claim 12, wherein the first material is aluminum and the second material is steel.

14. The double-screw compressor as claimed in claim 12, wherein the nominal center distance is slightly greater than the normal center distance for toothed gearings, Anorm, which is calculated according to the formula:

$$Anorm=((m_1 \cdot z_1)/2 \cos \beta_1))+((m_2 \cdot z_2)/2 \cos \beta_2))$$

where m is the module, z is the number of teeth and β is the helix angle and where the index numbers $_1$ and $_2$ represent one and the other gearwheel respectively.

15. The method as claimed in claim 14, the nominal center distance being selected within the range 1.0·Anorm to 1.0016·Anorm.

16. The method as claimed in claim 12, wherein the gas is air.

17. The method as claimed in claim 12, wherein the gas consumer is a fuel cell.

18. The method as claimed in claim 12, wherein the gas consumer is a combustion engine.

19. The method as claimed in claim 12, wherein the range is selected to be around 10°.

* * * * *